US007581935B2

(12) United States Patent
Hofmann et al.

(10) Patent No.: US 7,581,935 B2
(45) Date of Patent: Sep. 1, 2009

(54) DEVICE AND METHOD FOR CONTROLLING A THICK MATTER PUMP

(75) Inventors: Wilhelm Hofmann, Niederdorfelden (DE); Stefan Höfling, Seligenstadt (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 706 days.

(21) Appl. No.: 10/558,938

(22) PCT Filed: Mar. 18, 2005

(86) PCT No.: PCT/EP2005/002893

§ 371 (c)(1),
(2), (4) Date: Dec. 1, 2005

(87) PCT Pub. No.: WO2005/093251

PCT Pub. Date: Oct. 6, 2005

(65) Prior Publication Data

US 2006/0245942 A1 Nov. 2, 2006

(30) Foreign Application Priority Data

Mar. 26, 2004 (DE) ..... 10 2004 015 416

(51) Int. Cl.
*F04B 49/00* (2006.01)
*F04B 17/00* (2006.01)
*F04B 53/10* (2006.01)

(52) U.S. Cl. ..... 417/28; 417/46; 417/53; 417/342; 417/532; 417/900

(58) Field of Classification Search ..... 417/26, 417/28, 46, 342, 532, 900, 53
See application file for complete search history.

(56) References Cited

U.S. PATENT DOCUMENTS 5,209,649 A * 5/1993 Dose et al. ..... 417/342

(Continued)

FOREIGN PATENT DOCUMENTS

DE 42 06 576 A1 9/1993

(Continued)

*Primary Examiner*—Charles G Freay
(74) *Attorney, Agent, or Firm*—Patent Central LLC; Stephan A. Pendorf

(57) ABSTRACT

The invention relates to a device and a method for controlling a two-cylinder thick matter pump comprising delivery pistons that are actuated in a push-pull manner by means of a hydraulic reversible pump (6) and hydraulic drive cylinders controlled by said pump. For each pressure stroke, the delivery cylinders (50, 50') are connected to a delivery conduit (58) by means of a pipe junction (56). At the end of a pressure stroke, a reversal process of the reversible pump (6) and the pipe junction (56) is triggered. The aim of the invention is to obtain a targeted reversal of the reversal pump and the pipe junction, even when the deliverable quantity is varied, whereby the delivery cylinders are completely emptied, but also without pistons banging the ends of the cylinders. To this end, a computer-assisted reversal device is provided, said device comprising a measuring and evaluating routine for detecting the temporal displacement course of the piston along the path thereof between the two cylinder ends, by measurement and/or calculation, and for calculating a triggering time derived therefrom for the subsequent reversal of the reversible pump and the pipe switch.

11 Claims, 4 Drawing Sheets

U.S. PATENT DOCUMENTS

| | | | | |
|---|---|---|---|---|
| 5,401,140 | A * | 3/1995 | Anderson | 417/63 |
| 5,458,470 | A * | 10/1995 | Mannhart et al. | 417/517 |
| 6,171,075 | B1 * | 1/2001 | Munzenmaier et al. | 417/342 |
| 6,299,416 | B1 * | 10/2001 | Kwag | 417/403 |
| 6,779,983 | B1 * | 8/2004 | Olson | 417/53 |

FOREIGN PATENT DOCUMENTS

| | | | |
|---|---|---|---|
| DE | 195 42 258 | A1 | 5/1997 |
| DE | 100 38 647 | A1 | 2/2002 |
| EP | 0 562 398 | A1 | 9/1993 |
| EP | 0 567 826 | A2 | 11/1993 |

* cited by examiner

DEVICE AND METHOD FOR CONTROLLING A THICK MATTER PUMP

CROSS REFERENCE TO RELATED APPLICATION

This application is a national stage of PCT/EP2005/002893 filed Mar. 18, 2005 and based upon DE 10 2004 015 416.3 filed Mar. 26, 2004 under the International Convention.

BACKGROUND OF THE INVENTION

Field of the Invention

The invention concerns a device and a process for controlling a thick matter pump with two conveyor cylinders communicating via end openings in a material supply container operable in counter stroke by means of a hydraulic reversible pump and via these control hydraulic drive cylinders, with a hydraulic operated pipe switch provided within the material supply container, of which the inlet side is alternatingly connectible to one of the openings of the conveyor cylinders leaving open the respective other opening and on the outlet side connected with a conveyor conduit, wherein the passing-by of the piston is detected at each conveyor stroke in at least two sensor positions in predetermined spacing from each other and from the rod and/or bottom side end of the drive cylinder, and upon ending of the conveyor stroke, a switching or reversing process of the reversible pump and the pipe switch is initiated.

A device for control of a two cylinder thick matter pump of this type is known (DE 195 42 258), in which the end position of the piston of the drive cylinder can be determined by means of cylinder switch sensors or proximity sensors for producing end position signals. Here, the flow-through reversal of the reversible pumps is initiated by the end-position signal of the drive cylinder. As a rule, the end-position signal is conventionally triggered via the two cylinder switch sensors at the rod end of the cylinder. In the switching of the reversible pump and the pipe switch there always occur problems when the amounts to be conveyed are varied, for example, via a remote control. Therein it is to be taken into consideration, that the switching of the reversible pump does not occur instantaneously. It requires rather a certain reversal time for the carrying out of the movement of the slant disk present in the reversible pump. The switching-over times, in the conventional reversible pumps, lie at approximately 0.1 second. In a two second stroke this reversal interval represents approximately 5% of the stroke length. Further compounding this is additional delay times, for example for the switching of relays, which could lie in the same order of magnitude. This means, that for the switching of the reversible pumps, depending upon piston speed, distances can be achieved which could lead either to a banging of the piston at the base or lead to an incomplete emptying of the cylinder. For this reason there have already been provided cylinder switch sensors for signal production of the piston passage in the area of the end positions spaced apart from the rod or base side end of the cylinder. If the piston passes also through this sensor position, then there still remains available a certain amount of piston travel distance for switching over. With known two cylinder thick matter pumps the position of the cylinder switch sensors was so selected that at maximal possible piston speed a switching of the reversible pump, which just leads to a contact of the piston with the base, is made possible. If the piston travels slower than this maximum, then on the basis of the constant switch time of the reversible pump and the reaction time of the relays, this leads thereto, that the piston during this time does not run all the way to the adjacent base. Thus a residual amount of concrete remains in the cylinder, which during a piston stroke is not extruded out of the cylinder. This can lead to a hardening of the concrete and to an obstruction. In the case of single circuit pumps the one and the same hydraulic pump also switches over the pipe switch. This must occur at precisely the time at which the piston reaches the base side or the rod side end. Only then is the pump pressure sufficient for the switching over of the pipe switch. A particular problem of the single circuit pump is thus comprised therein, that the time point of the switching of the reversible pump, the stopping of the piston and the switching of the pipe switch must be coordinated precisely to each other. In two circuit pumps, in which the pipe switch is switched over via a pressure accumulator, the coordination problems may be somewhat reduced. Similarly however herein there is also need for a suitable coordination to ensure that the piston so completely traverses the cylinder in order to avoid undesired residual amounts of concrete in the cylinders.

SUMMARY OF THE INVENTION

Beginning therewith, it is the task of the present invention to develop a device and a process for controlling a thick matter pump of the above described type, whereby a complete emptying of the cylinder at each piston stroke is made possible, and nevertheless an undesired banging of the piston at the end of the drive cylinder is avoided.

The inventive solution is based upon the idea that, with at least two cylinder switch sensors provided on any position in the drive cylinder, which are provided spaced apart from each other and from the two ends, a detection of movement of the drive piston is made possible, which, with the assistance of a computer assisted switching device with suitable software, enables a complete detection of the course of movement of the piston along the work cylinder and therewith the solution of the above indicated problems. In order to accomplish this, it is primarily proposed in accordance with the invention, that the computer assisted switching device includes a measurement and evaluation routine for measurement-technical and/or computer assisted detection of the time/movement course of the piston on its way between the two cylinder ends, as well as for computing a therefrom derived time point for initiation of the switching of the reversible pump and the pipe switch.

One preferred embodiment of the invention envisions that the measurement and evaluation routine includes an algorithm for detecting the time of the piston passage at the location of the cylinder switch sensor as well as for calculating a therefrom derived initiation or trigger time point for a switching of the reversible pump and the pipe switch at each piston stroke, with taking into consideration of a predetermined or computed interval time of the piston until the respective impact at the cylinder end. The interval time of the piston is essentially comprised of the reaction time of the switch relay and the switching-over time of the reversible pump.

With constant operating mode, without changing the conveyed amounts, there can be computed or assigned at each time interval, which is measured as reference value for the speed, a initiation point for the switching over of the reversible pump and the pipe switch. The detection of time can in this case occur for example via a switch impulse for the pipe switch. The distance between two switches of the pipe switch correspond then to the measured stroke duration. With taking into consideration the measured stroke duration then, during passage of the piston through one of the two cylinder switch sensors, the initiation time point for the switching can be determined. This value is approximately constant for one and the same type of pump design. A special circumstance occurs when the conveyed amount within the pipe stroke is to be changed. In this case a new conveyance mount must be taken into consideration and a corresponding residual run-time must be calculated in order to determine the precise initiation point.

A preferred design of the invention accordingly provides that the measurement and evaluation routine includes an algorithm for calculating the speed of the piston on its path between the cylinder switch sensors and a therefrom derived initiation point for the switching process, with taking into consideration of a predetermined or computed brake or dwell time of the piston until the respective end-impacting in the cylinders.

A preferred embodiment of the invention envisions that the measurement and evaluation routine consults preset values for the conveyor amounts of the reversible pump input in a preferably remote control device and an algorithm for determining the piston speed plot and the therefrom derived next initiation point in time for the switching process according to the magnitude of the currently set target value. Therein it is of particular value, when the measurement and evaluation routine includes an algorithm for determining the interval time or the travel path of the piston according to the magnitude of the instantaneous measured or calculated piston speed and a therefrom derived initiation time point for the switch process.

In accordance with the inventive process, it is primarily decided that the time movement sequence of the piston is measured and/or computed while on its path between the two cylinder ends and therefrom the respective next initiation or actuation point in time for the switching process is derived. A preferred embodiment of the invention envisions that the passage or transition of the pistons at the location of the cylinder switch sensors is detected in time-relation to each other, and that therefrom the initiation point in time for the respective following switching of the reversible pump and the pipe switch is computed, taking into consideration a predetermined or computed brake time of the piston until the respective end banging of the cylinder. Therein the speed of the piston on its way between the selected cylinder switch sensors can be computed and therefrom the next point in time for the switching process can be derived.

A further preferred mode of the inventive process is comprised therein, that the movement of the piston over time is changed via remote control demand values for the conveyed mounts, and that from the, according to the value or magnitude of the demand value calculated movement sequence of the piston, with taking into consideration of a thereby modified brake time, the next initiation or actuation point for the switching process is derived. For this it can be useful, that brake time or the interval path of the piston is determined from the measured or the computed instantaneous piston speed with respective taking into consideration of the device-specific response and switch times for the reversible pump, and therefrom calculates the respective next initiation point in time.

BRIEF DESCRIPTION OF THE DRAWINGS

In the following the invention will be described in greater detail on the basis of illustrative embodiments shown in greater detail in schematic manner in the figures. There is shown FIG. 1 A section of a two cylinder thick matter pump in partial sectional perspective representation.

DETAILED DESCRIPTION OF THE INVENTION

Figure 1:
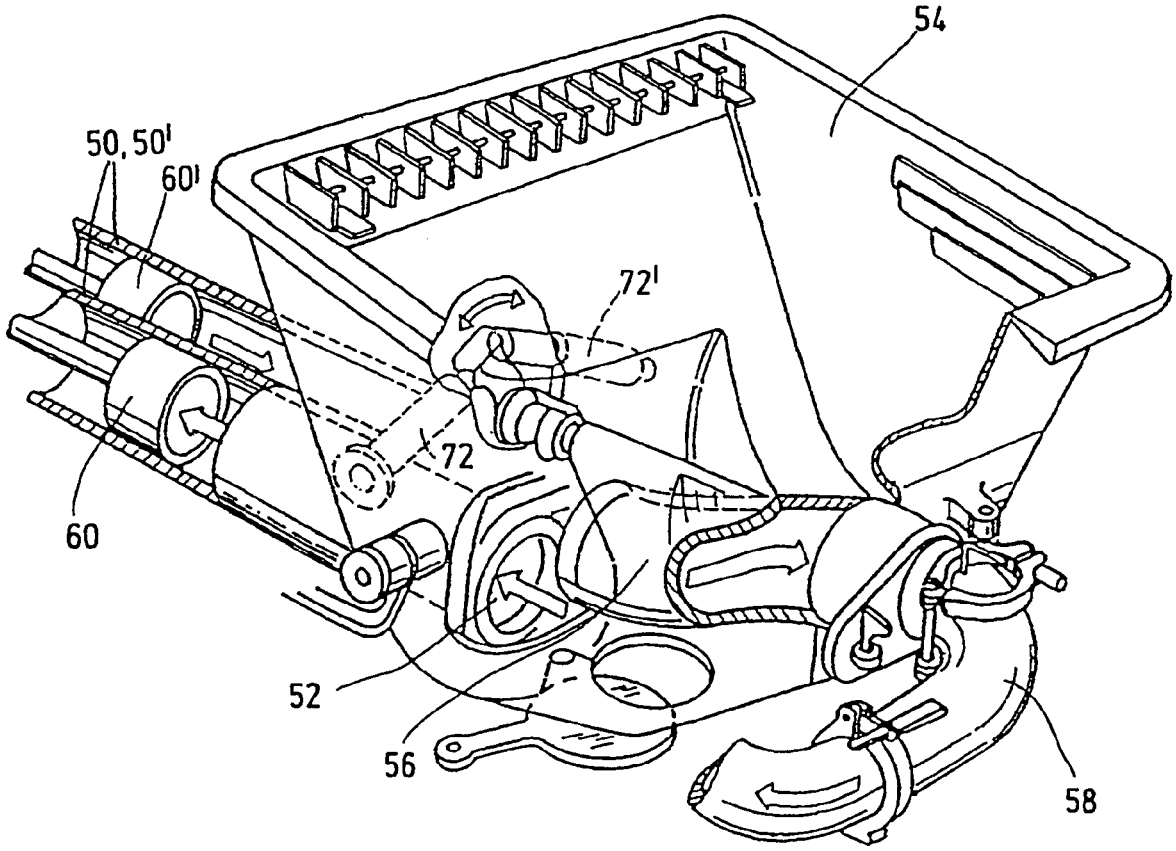
Figure 2:
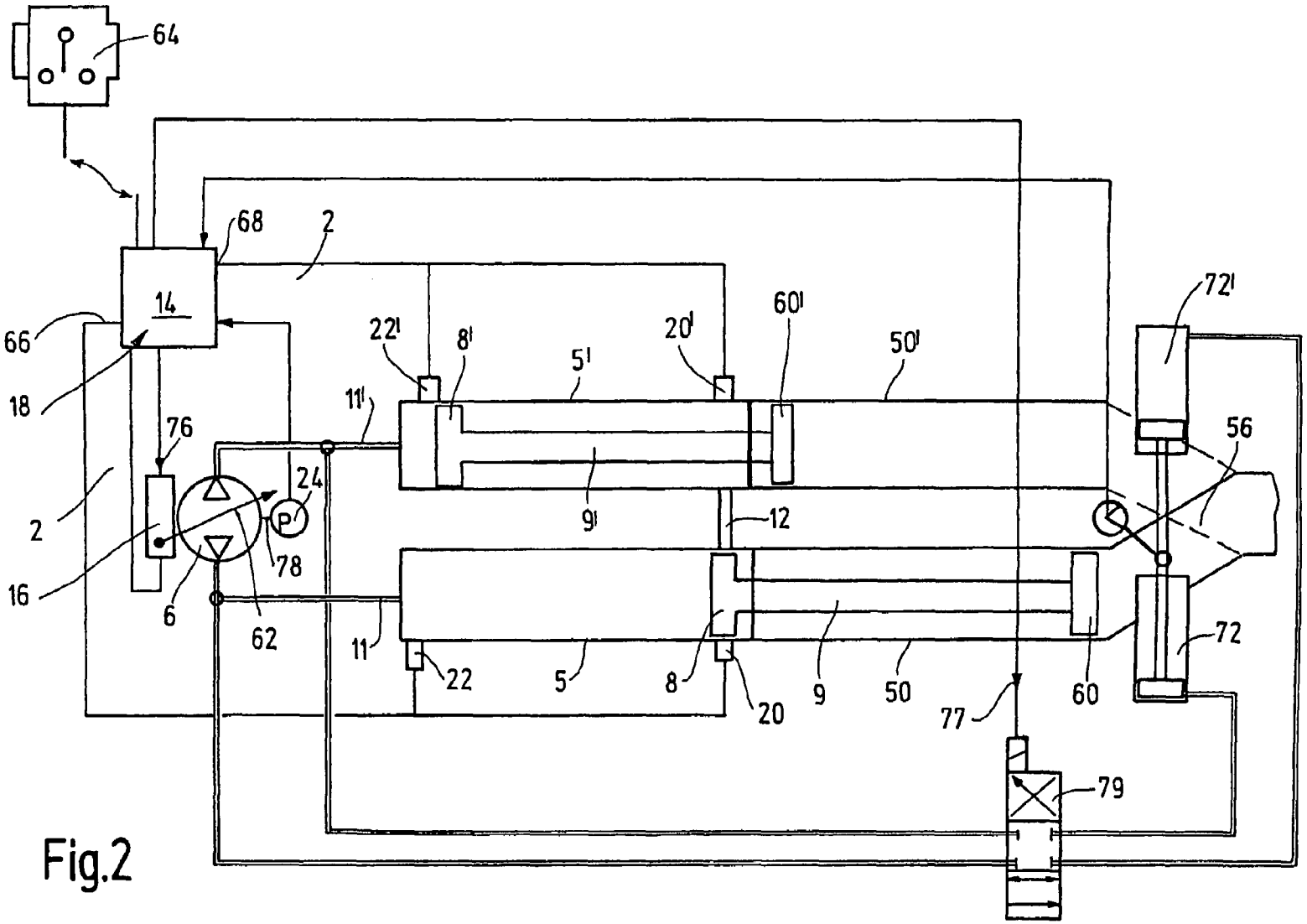
FIG. 2 A circuit diagram of a computer-controlled drive hydraulic for the two cylinder thick matter pump.
Figure 3:
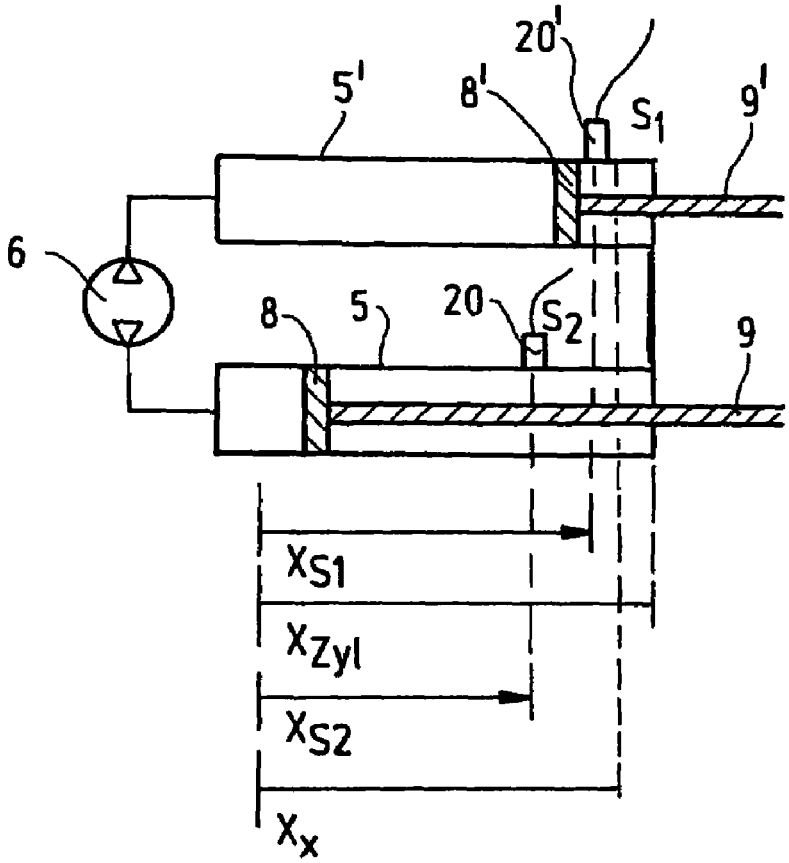
FIG. 3 A section from FIG. 2 with a few indications of value for the computation of a preferred initiation time point.

The control arrangement shown in FIG. 2 and 3 is intended for the thick matter pump corresponding to FIG. 1. The thick matter pump includes two conveyor cylinders 50, 50', of which the end openings 52 communicate in a material supply container 54 and alternatingly can be connected during the pressure stroke with a conveyor conduit 58 via a pipe switch 56. The conveyor cylinders 50, 50' are operated in counter stroke via hydraulic drive cylinders 5, 5' and a reversible hydraulic pump 6. For this purpose the conveyor pistons 60, 60' of the conveyor cylinder 50, 50' are each connected with a piston 8, 8' of the drive cylinder 5, 5' via a common piston rod 9, 9'.

In the illustrative embodiment the drive cylinders 5, 5' are acted upon with hydraulic pressure on the base side via hydraulic lines 11, 11' of the hydraulic circulation assisted by the reversible pump 6 and are, on their rod side end, connected hydraulically with each other via an oscillating oil conduit 12. The direction of movement of the drive pistons 8, 8' and therewith the common piston rods 9, 9' are reversed due to the flow-through direction of the reversible pump 6 being reversed via a reversing device 18 containing a computer 14 and a switch mechanism 16. The reversible pump 6 has for this purpose a slant disk 62, which for reversing is pivoted through its zero position, so that the conveyor device reverses the oil pressure in the hydraulic conduits 11, 11'. The conveyed amount of the reversible pump 6 can be varied, while keeping constant a predetermined rotational speed of a not shown drive motor, by changing the pivot angle of the slant disk 62. The pivot angle of the slant disk 62 can therein be adjusted via a remote control device 64 with the support of a computer 14.

The reversing of the reversible pump and the pipe switch 56 occurs as soon as the piston 8, 8' of the drive cylinders 5, 5' reach their end position. The reversing device evaluates output signals of the respective cylinder sensors 20, 22 and 20', 22', provided respectively a distance from the rod side and base side ends of the two drive cylinders 5', 5', which on the output side are connected with the computer 14 of the control device 18. The cylinder switch sensors react to the drive pistons 8, 8' running thereby during operation of the pump, and signal this occurrence to the computer input 66, 68. Upon occurrence of the output signals a reverse signal 76 is initiated time-delayed in the reversing device, which reverses the reversible pump 6 via the adjusting mechanism 16. In the sequence of the reversal process there is initiated in addition, via a signal 77, a reversal of the pipe switch 56 via the direction control valve 79 and the plunger cylinder 72, 72'. In normal operation it is primarily the signals of the rod side cylinder switch sensors 20, 20' that are employed for producing a reverse signal. For this, the computer 14 includes a measurement and evaluation routine 40 (See FIG. 5), in which the initiation signal of the rod side cylinder switch sensors 20, 20' are evaluated with formation of a reverse signal 76, 77 for the reversible pump 6 and/or the pipe switch 56.

Figure 4:
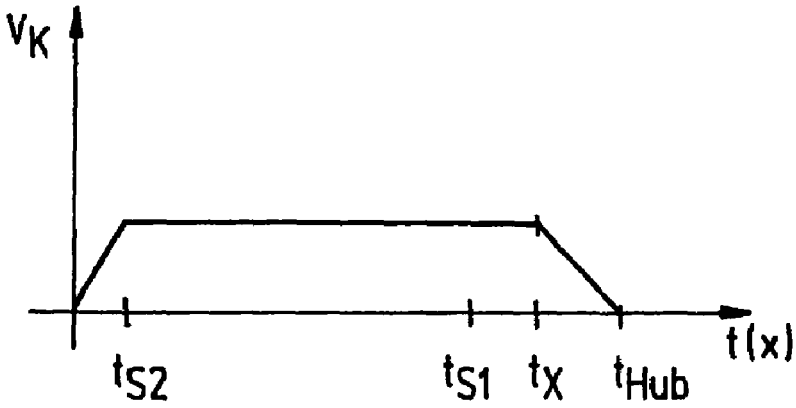
FIG. 4 A speed-/time-diagram of the piston movement along the drive cylinders.

In the following there will be described in greater detail on the basis of FIGS. 3 and 4 a method of calculating which forms the basis of the measurement and evaluation routine 40.

In FIG. 3 the rod side cylinder switch sensors 20, 20' are referenced with $S_1$ and $S_2$. In accordance therewith the sensor positions from the base side end of the drive cylinder are indicated with $X_{S1}$ and $X_{S2}$, while the useful length of the cylinder, which is computed from the cylinder length minus piston length, is referenced with $X_{Zyl}$. Herein this is concerned with the maximal piston stroke. The position $X_{S1}$, $X_{S2}$ of the cylinder switch sensors and the useful $X_{Zyl}$ are known.

The object of the invention is the calculation of a position of $X_x$ or, as the case may be, the associated time $t_x$ for the piston passage through at location $X_x$, from which point the reversible pump must be reversed, so that a complete piston stroke without hard banging at the cylinder base can be achieved. This position is dependent upon the conveyed amount, however is independent of the position of the cylinder switch sensors (See FIG. 4). The speed $V_K$ of the piston is produced from the useful length $X_{Zyl}$ and the stroke time $t_{Hub}$ as well as the acceleration and brake paths and times $X_{Beschl}$, $X_{Brems}$, $t_{Beschl}$, $t_{Brems}$ as:

$$V_K = \frac{X_{Zyl} - X_{Beschl} - X_{Brems}}{t_{Hub} - t_{Beschl} - t_{Brems}}$$

The brake (deceleration) or initiation point for reversal follows as:

$$X_x = X_{Zyl} - X_{Brems}$$

Wherein for simplification a presumption is made of a constant brake acceleration $b_{brems}$:

$$t_{brems} = V_K / b_{brems}$$

From this it follows:

$$X_x = X_{Zyl} - \frac{1}{2} \cdot \frac{V_K^2}{b_{brems}}$$

The brake time point is accordingly calculated as:

$$t_x = t_{Hub} \cdot \frac{X_x}{X_{Zyl}}$$

A more precise determination of the initiation point is possible, as supplemental information of the piston passage through the switch position $S_1$ or as the case may be $S_2$ is undertaken. Thus there is computed for example the time between the stroke start and the switch 1 as:

$$t_{xS1} = \frac{X_{S1}}{X_{Zyl}} \cdot t_{Hub}$$

For the initiation or start time starting with switch 1 there results the value $$\Delta t_{x1} = t_x - t_{xS1}$$

Similar applies for the position $X_{S2}$ of the cylinder switch sensor $S_2$:

$$\Delta t_{x2} = t_x - t_{xS2}$$

In the case of the switch $S_1$ or as the case may be $S_2$ is passed by prior to the initiation point in time, then the time $\Delta t_{x1}$ or as the case may be $\Delta t_{x2}$ will begin after the passage by the cylinder switch sensor. If the cylinder switch sensors lie behind the initiation position, then the initiation time is computed beginning with the beginning of the stroke.

Analogously to the above described methods of computation the initiation point can also be determined in the case of a change in the conveyed amount. For this the useful length $X_{Zyl}$ is to be divided (stroke shortened) depending upon the change in the conveyed amount, and the new speed $V_K$ of the piston (in the short stroke) be determined for the calculation of the time to brake. This is a known value, based on the required amount to be conveyed.

Figure 5:
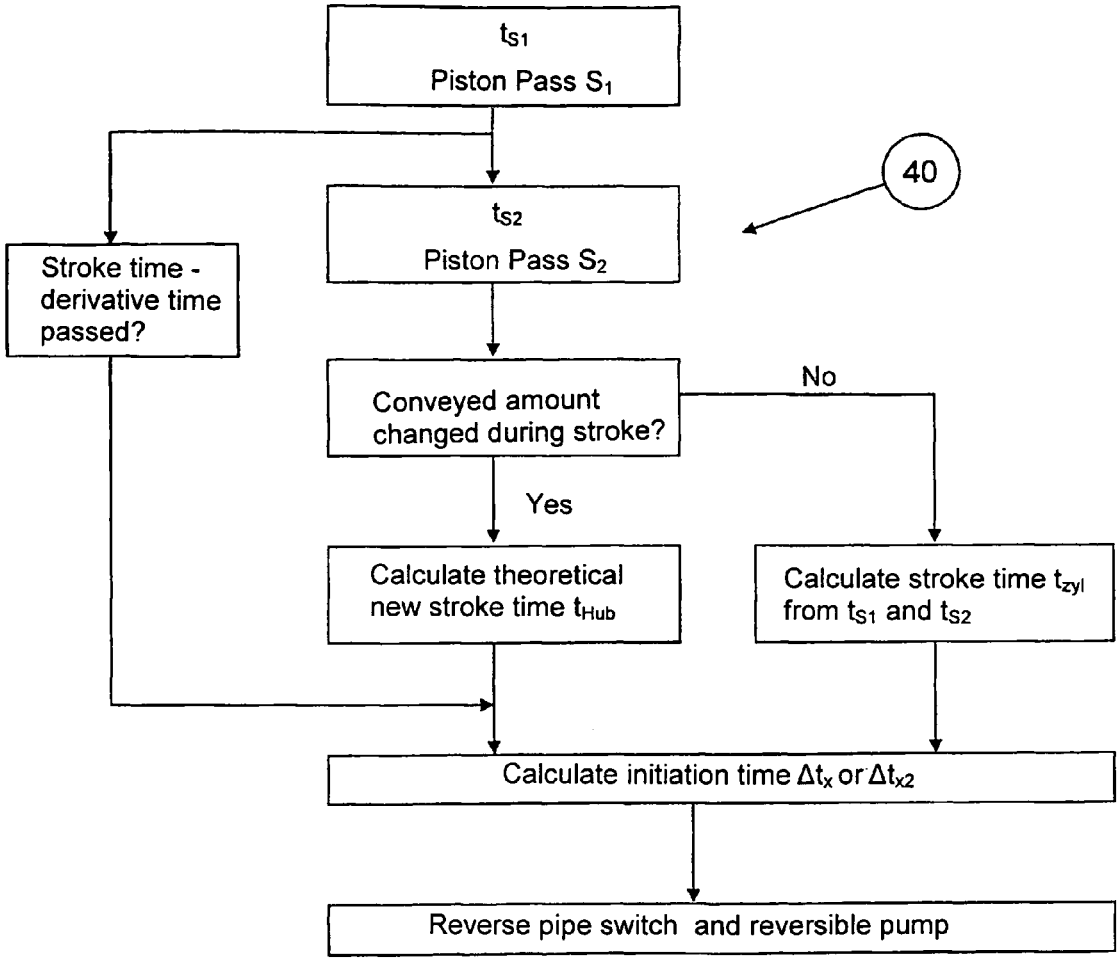
FIG. 5 A flow diagram of the measurement and initiation routine.

The flow diagram of the measurement and evaluation routine 40 in FIG. 5 illustrates the measurement and control processes during the piston movement in the work cylinders. At the positions $S_1$ and $S_2$ of the cylinder switch sensors the time point $t_{S1}$ and $t_{S2}$ of the passing by pistons is determined and therefrom the theoretical stroke time $t_{Hub}$ is computed or calculated. In the case that the conveyor amount is changed in between, this has an impact upon the stroke time $t_{Hub}$ and therewith also upon the piston speed. These values are then taken into consideration in the computation of the initiation time, which finally leads at the point in time $t_x$ or as the case may be $\Delta t_x$ to initiation of the reverse movement in the pipe switch and the reversible pump.

In order to ensure a safe and reliable concrete conveyance also in the case of a loss of one or the other cylinder switch sensors $S,S_2$, there is parallel to the event measurements at the cylinder switch sensors, a hold back time is input for the stroke time, which independently of the measurement process at the cylinder switch sensors can initiate, via a parallel branch, the reversing of the pipe switch and the reversible pump.

In summary the following can be concluded: The invention relates to a device and a method for controlling a two-cylinder thick matter pump comprising delivery pistons that are actuated in a push-pull manner by means of a hydraulic reversible pump 6 and hydraulic drive cylinders controlled by said pump. For each pressure stroke, the delivery cylinders 50, 50' are connected to a delivery conduit 58 by means of a pipe switch 56. At the end of a pressure stroke, a reversal process of the reversible pump 6 and the pipe switch 56 is triggered. The aim of the invention is to obtain a targeted reversal of the reversal pump and the pipe junction, even when the deliverable quantity is varied, whereby the delivery cylinders are completely emptied without pistons slamming or bottoming out in the drive cylinders. To this end, a computer-assisted reversal device is provided, said device comprising a measuring and evaluating routine for detecting the temporal displacement course of the piston along the path thereof between the two cylinder ends, by measurement and/or calculation, and for calculating a triggering time derived therefrom for the subsequent reversal of the reversible pump and the pipe switch.

The invention claimed is:

1. A thick matter pump with two conveyor cylinders (50, 50') communicating via two end openings (52) in a material supply container (54), the conveyor cylinders (50, 50') operated in counter stroke by a hydraulic reversible pump (6) via hydraulic drive cylinders (5, 5') driven by the reversible pump, the hydraulic drive cylinders (5, 5') each having a rod end and a base end;

with a hydraulically actuated pipe switch (56) provided within the material supply container (54), the pipe switch having an inlet and an outlet, which pipe switch inlet is alternatingly connectable to one of the openings (52) of the conveyor cylinders (50, 50') freeing the respective other opening of the conveyor cylinders (50, 50'), and which pipe switch outlet is connected with a conveyor conduit (58), wherein the drive cylinders (5, 5') are hydraulically connected at the base end via respectively one hydraulic conduit (11, 11') to a connector of the reversible pump (6) and at their rod end are hydraulically connected with each other via an oscillating oil conduit (12);

with at least two cylinder switch sensors (20, 20'; 22, 22') in predetermined separation from each other and spaced from the rod ends and/or base ends of the drive cylinders (5, 5') and sensitive to the passage by of a piston (8, 8') of the drive cylinder; and with a device (18) for controlling the thick matter pump responsive to the output signal of each cylinder switch sensor for reversing the reversible pump (5) and the pipe switch (56) after completion of a piston stroke, wherein the device is a computer assisted reversing device including a measurement and evaluation routine for determining, by measurement or computation, the temporal displacement of the piston on its way between the two cylinder ends, as well as for computing therefrom a derived initiation time for the subsequent reversing of the reversible pump and the pipe switch.

2. The thick matter pump according to claim 1, wherein the measurement and evaluation routine includes an algorithm for determining the time of the piston detection at the location of the cylinder switch sensors as well as for computing the therefrom derived initiation time point for a reversing of the reversible pump and the pipe switch at each piston stroke, taking into consideration a predetermined or computed brake time of the piston prior to a respective impact at the end of the cylinder.

3. The thick matter pump according to claim 1, wherein the measurement and evaluation routine includes an algorithm for computing the speed of the piston on its way between the cylinder switch sensors and a therefrom derived initiation time point for the next reversing process, taking into consideration a predetermined or computed brake time of the piston prior to the respective impact at the end of the cylinder.

4. The thick matter pump according to claim 1, wherein the measurement and evaluation routine responds to a target value for the conveyed amount of the reversible pump and includes an algorithm for determining the characteristic of the piston speed and the therefrom derived initiation time point for the next reversal process according to the measure of the current set target value.

5. The thick matter pump according to claim 4, wherein the measurement and evaluation routine responds to a target value input via a remote control for the conveyed amount of the reversible pump.

6. The thick matter pump according to claim 1, wherein the measurement and evaluation routine includes an algorithm for determining the brake time or the brake path of the piston according to the magnitude of the instantaneously measured or computed piston speed and the therefrom derived initiation time point for the reversal process.

7. A process for controlling a thick matter pump with two conveyor cylinders (50, 50') communicating with two end openings (52) in a material supply container (54), the two conveyor cylinders (50, 50') operated in counter stroke via at least one hydraulic reversible pump (6) and via hydraulic drive cylinders (5, 5') driven by the reversible pump (6), the hydraulic drive cylinders (5, 5'') each having a rod end and a base end; and with a pipe switch provided within the material supply container (54), the pipe switch having an inlet and an outlet, the pipe switch inlet alternatingly connectable to the openings (52) of the conveyor cylinders (50, 50') for a conveyance stroke freeing the respective other opening, and the pipe switch outlet connected with a conveyor conduit (58), the process comprising:

(a) monitoring each conveyance stroke via at least two cylinder switch sensors (20, 20'; 22, 22') at sensor positions spaced with predetermined separation from each other and from the rod and base ends of the drive cylinder (5, 5'), (b) using the output of the cylinder switch sensors (20, 20'; 22, 22') to measure or compute the position over time of the piston on its way between the rod and base ends of the drive cylinders.

(c) deriving therefrom the initiation time point for the respective next reversal process, and (d) initiating at the initiation time point a reversing the reversible pump (5) and the pipe switch (56).

8. The process according to claim 7, wherein the passing of the pistons at the location of the cylinder switch sensors are detected in time relation to each other and that therefrom the initiation time point for the respective following reversal of the reversible pump and the pipe switch is calculated, taking into consideration a predetermined or computed brake time of the piston prior to the respective impacting at the end of the cylinder.

9. The process according to claim 7, wherein the speed of the piston on its way between the cylinder switch sensors is calculated and that therefrom the initiation time point for the respective subsequent reversal of the reversible pump and the pipe switch is derived taking into consideration a predetermined or computed brake time of the piston prior to the respective impacting at the end of the cylinder.

10. The process according to claim 7, wherein the movement of the piston over time is changed in response to a remote control input changed target value for the conveyed amount, and that from the computed movement sequence of the piston according to the value of the input changed target value, taking into consideration the difference in brake time associated with the changed movement of the piston over time, the initiation time point for the subsequent reversal process is derived.

11. The process according to claim 7, wherein the brake time or brake path of the piston is determined based on the piston speed, respectively taking into consideration the device specific reaction time and reverse time of the reversible pump, and therefrom the respective next initiation time point is computed.

* * * * *